US006405497B1

(12) United States Patent
Christopolous

(10) Patent No.: US 6,405,497 B1
(45) Date of Patent: Jun. 18, 2002

(54) WINDOW GATE

(76) Inventor: George Christopolous, 66 Milford Haven Dr., Toronto, Ontario (CA), M1G 3C8

( * ) Notice: Subject to any disclaimer, the term of this patent is extended or adjusted under 35 U.S.C. 154(b) by 0 days.

(21) Appl. No.: 09/610,875

(22) Filed: Jul. 6, 2000

(30) Foreign Application Priority Data

Jul. 6, 1999 (CA) ..... 2276969
Jun. 23, 2000 (CA) ..... 2312605

(51) Int. Cl.[7] ..... E06B 9/02; E06B 3/38
(52) U.S. Cl. ..... 52/202; 52/217; 52/507; 52/106; 49/54; 49/55
(58) Field of Search ..... 52/202, 656.7, 52/507, 106, 217; 49/50, 55, 51, 56, 57, 60, 54, 61, 65

(56) References Cited

U.S. PATENT DOCUMENTS 683,217 A * 9/1901 Mower ..... 49/57
807,276 A * 12/1905 Johnston ..... 49/55
2,829,712 A * 4/1958 Quinn ..... 160/102
4,059,413 A * 11/1977 Forgione ..... 49/56
4,437,265 A * 3/1984 Turro et al. ..... 49/57
4,939,866 A * 7/1990 Kluge ..... 49/55
5,018,302 A * 5/1991 Kluge ..... 49/56
5,070,647 A * 12/1991 Spialter ..... 49/55
5,943,832 A * 8/1999 Russell ..... 52/202

* cited by examiner

*Primary Examiner*—Carl D. Friedman
*Assistant Examiner*—Winnie Yip

(57) ABSTRACT

A gate for sliding windows or doors in a frame is provided. The gate provides two gate elements. The first element is attached to the window frame. The second element is attached to the sliding window. The two elements are coupled together to allow each element to slide across the other. The elements are positioned in the frame to create a barrier in a space created when a window is slid to an open position.

5 Claims, 9 Drawing Sheets

WINDOW GATE

FIELD OF THE INVENTION

The invention relates to a gate for a sliding window or door.

BACKGROUND OF THE INVENTION

Sliding windows are common in typical residential and commercial buildings. Generally, the windows comprise a window frame and a plurality of sliding windows situated therein. Typically the sliding windows are frictionally held within the frame in tracks. Each window can be slid along the track to various positions relative to the frame. As such, the window elements collectively can be arranged to fully close an area of the window frame or to open an area within the frame, thereby allowing air to move between the outside and inside of the building.

When the window is open, many things can pass through the open area, including burglars, children, adults, pets and other objects. In high-rise apartment buildings there is always the potential danger of a child (or adult) falling through an open window.

Previously, barriers have been installed around window frames to inhibit things passing through window openings. Gates can be installed around the window frame; however such frames span the entire window frame and thus block the view outside through closed parts of the window. Examples of such gates are described in Canadian Patents 2,003,533 and 1,144,428.

There remains a need for a window gate which addresses the shortcomings of the prior art.

SUMMARY OF THE INVENTION

The present invention provides a gate for a window frame having windows. The invention comprises first and second gate elements. The first gate element is attachable at its far end to the frame and the second gate element is attachable at its far end to one of the windows. The gate elements are coupled together to allow the gate elements to slide along each other and to provide a barrier in a space created between the window and the window frame when the sliding window is in an open position.

It is a further aspect of the invention to provide a gate comprising first and second gate elements, with each gate element having a substantially U-shape configuration comprising arms attached to a base. The first gate element can be attached at its open end to the frame and the second gate element can be attached at its open end to the sliding window. The first and second gate elements are coupled together allowing the gate elements to slide along each other and providing a barrier in the space created between said window and said window frame.

It is a further aspect of the invention to provide a gate comprising a plurality of substantially rectangular-shaped gate elements. The gate elements are oriented adjacent to one another in a side-by-side arrangement. Each gate element is pivotally attached along its adjacent edge to the adjacent edge of the adjacent gate element. The exterior ends of the gate can be pivotally attached to the frame and the sliding window.

BRIEF DESCRIPTION OF THE DRAWINGS

Preferred embodiments of the invention are shown in the drawings, wherein.

DETAILED DESCRIPTION OF THE PREFERRED EMBODIMENTS

The present invention provides an inexpensive, easily manufactured, assembled and installed window gate to provide a barrier for window openings.

The various figures show aspects of the invention alone and installed in a window frame. For clarity, same reference numbers are used to identify same items throughout the figures where appropriate.

Figure 1:
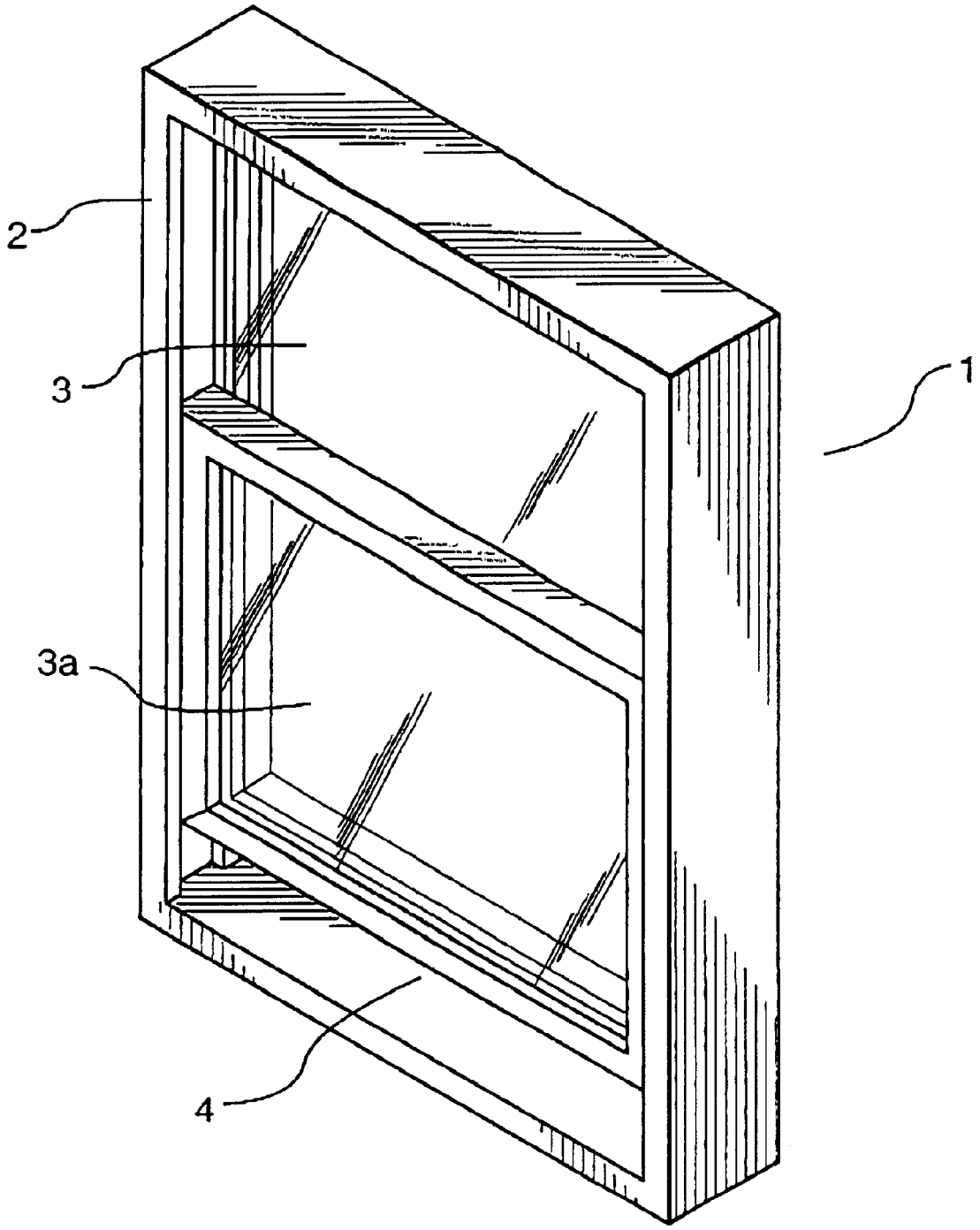
FIG. 1. is a diagram of a typical sliding window.

As seen in FIG. 1, vertical window unit 1 comprises window frame 2 and windows 3 and 3*a*. Each window 3, 3*a* slidably moves vertically along the inside of the frame. Opening 4 is created when windows 3 and 3*a* are positioned in the frame as shown. Window units are available which allow vertical or horizontal movement its windows.

Figure 2:
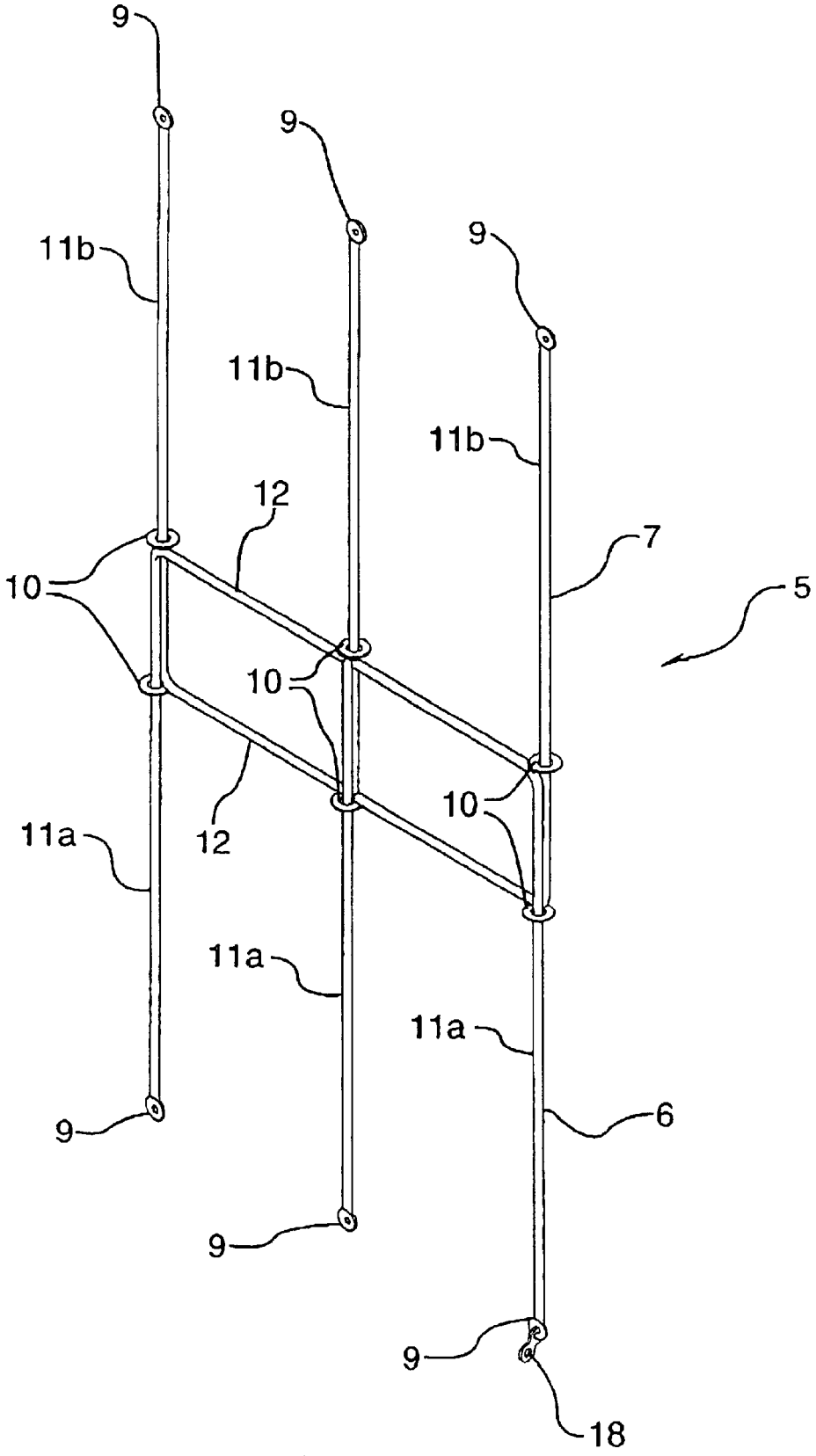
FIG. 2 is a diagram of a gate embodying the invention.

FIG. 2 shows a gate incorporating the invention uninstalled in a window frame. Gate 5 comprises a generally U-shaped first gate element 6 and a generally U-shaped second gate element 7. The first gate element generally comprises a plurality of parallel arms 11*a* transversely attached to an end 12. The second gate element generally comprises a plurality of parallel arms 11*b* transversely attached to an end 12. The gate elements can be made from various metals, plastics or wood. It can be appreciated that the gate elements may be formed from a single piece of material suitably shaped or, alternatively, by assembling several separate pieces including arms, bases and joints. Coupling elements 10 couple arms 11*a* and 11*b* together. In a preferred embodiment of the invention, the coupling elements are circular rings attached to one of the arms through which the other arm slides. It can be appreciated that other coupling elements, such as tubes or the like, may be used. With this coupling arrangement, gate elements 6 and 7 can be slidably moved towards and away from each other. At distal ends 9 of the arms, loops provide means to facilitate fastening the gate elements to appropriate locations on windows using screws, nails or other fasteners. It can be appreciated that other loop-like designs accomplish the same functionality. Hooks 18 may also be used which may be fastened appropriately to a window or window frame.

Figure 2A:
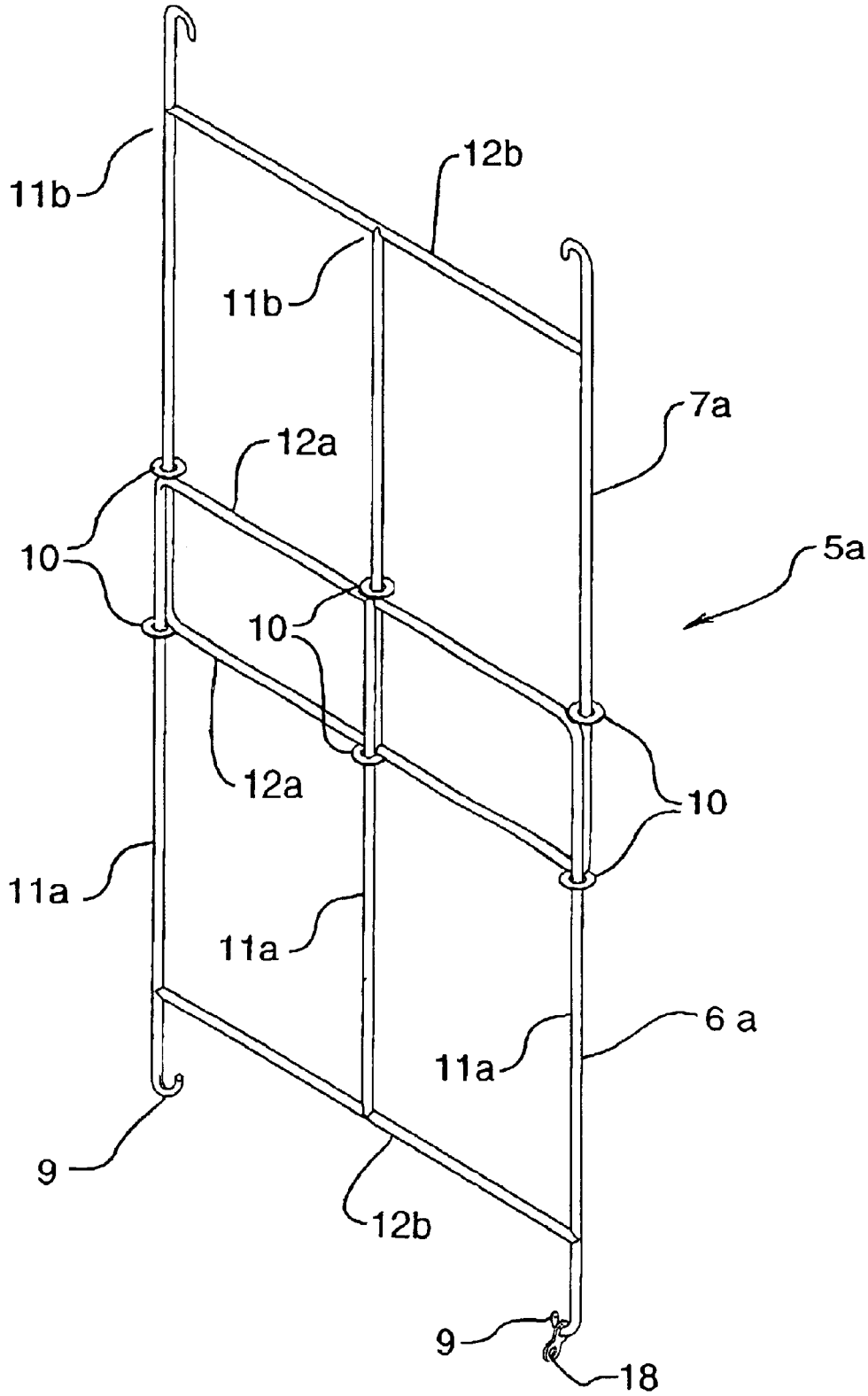
FIG. 2*a* is a diagram of another gate bodying the invention.

FIG. 2*a* shows another gate incorporating the invention uninstalled in a window. Gate 5*a* comprises a generally rectangular first gate element 6*a* and a generally rectangular second gate element 7*a*. The first gate element generally comprises a plurality of arms 11*a* attached to an end 12*a*. End 12*b* transversely joins members 11*a* at a spaced distance from end 12*a*. The second gate element generally comprises a plurality of arms lib attached to an end 12*a*. Similarly, end 12*b* transversely joins members 11*b* at a spaced distance from end 12*a*. It can be appreciated that the gate elements may be formed from a single piece of material suitably shaped or, alternatively, by assembling several separate pieces including arms, bases and joints. Coupling elements 10 couple arms 11*a* and 11*b* together. Fastening hook 18 is shown in place in loop 9.

Figure 2B:
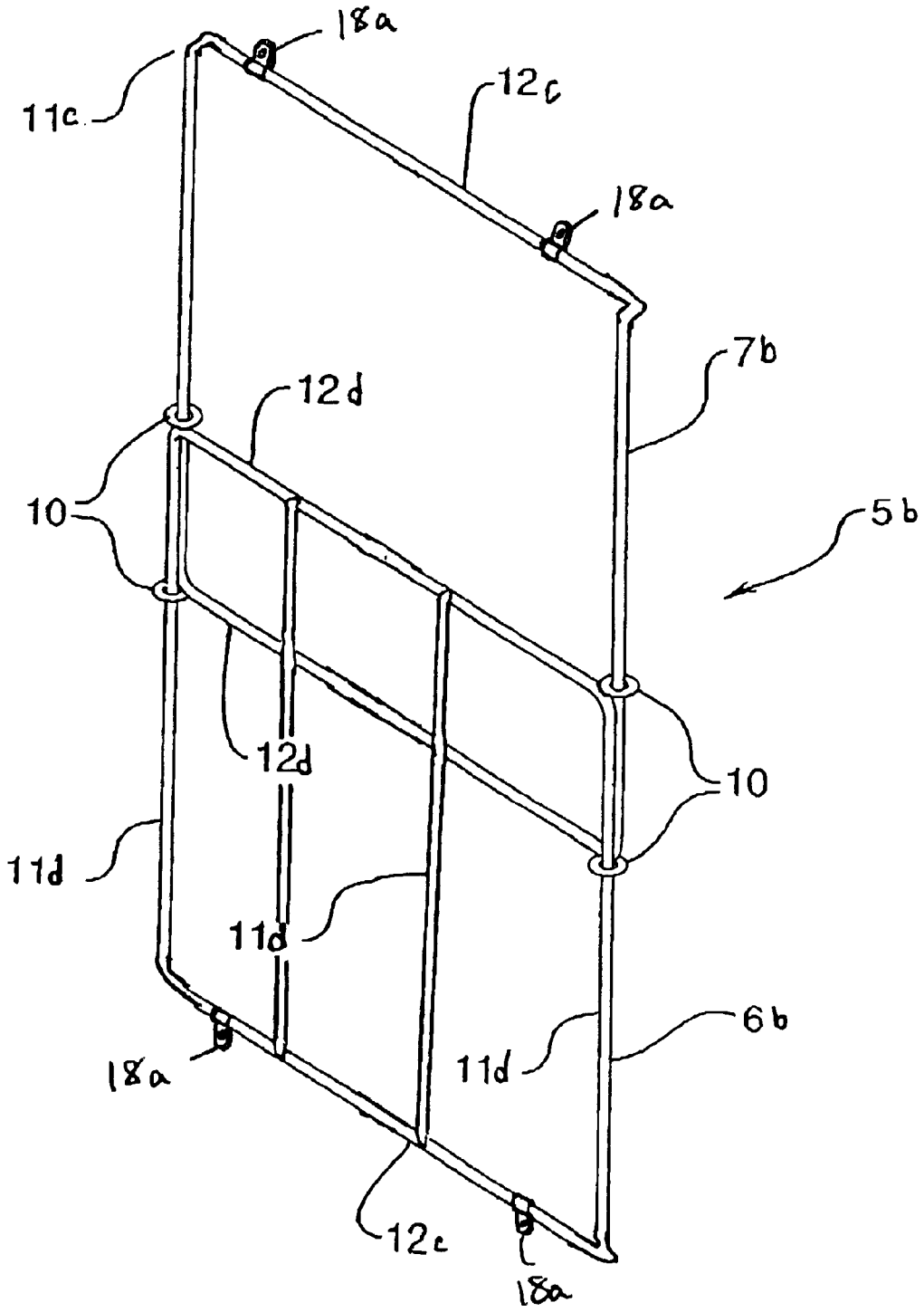
FIG. 2*b* is a diagram of another gate embodying the invention.

FIG. 2*b* shows another gate incorporating the invention uninstalled in a window. Gate 5*b* comprises a generally rectangular first gate element 6*b* for attachment to a slidable window and a generally rectangular second gate element 7*b* for attachment to the window frame. The first gate element 6*b* generally comprises an open rectangle comprised of arms 11*c* attached to an end 12*c*. End 12*d* transversely joins members 11*a* at a spaced distance from end 12*c*. The second gate element generally comprises a plurality of arms 11*d* attached to an end 12*c*. Similarly, end 12*d* transversely joins members 11*d* at a spaced distance from end 12*c*. It can be appreciated that the gate elements may be formed from a single piece of material suitably shaped or, alternatively, by assembling several separate pieces including arms, bases and joints. Coupling elements 10 couple arms 11*c* and 11*d* together. Fastening tabs 18 are shown slidably engaged with ends 12*b* for attachment of the gate to a window.

Figure 3:
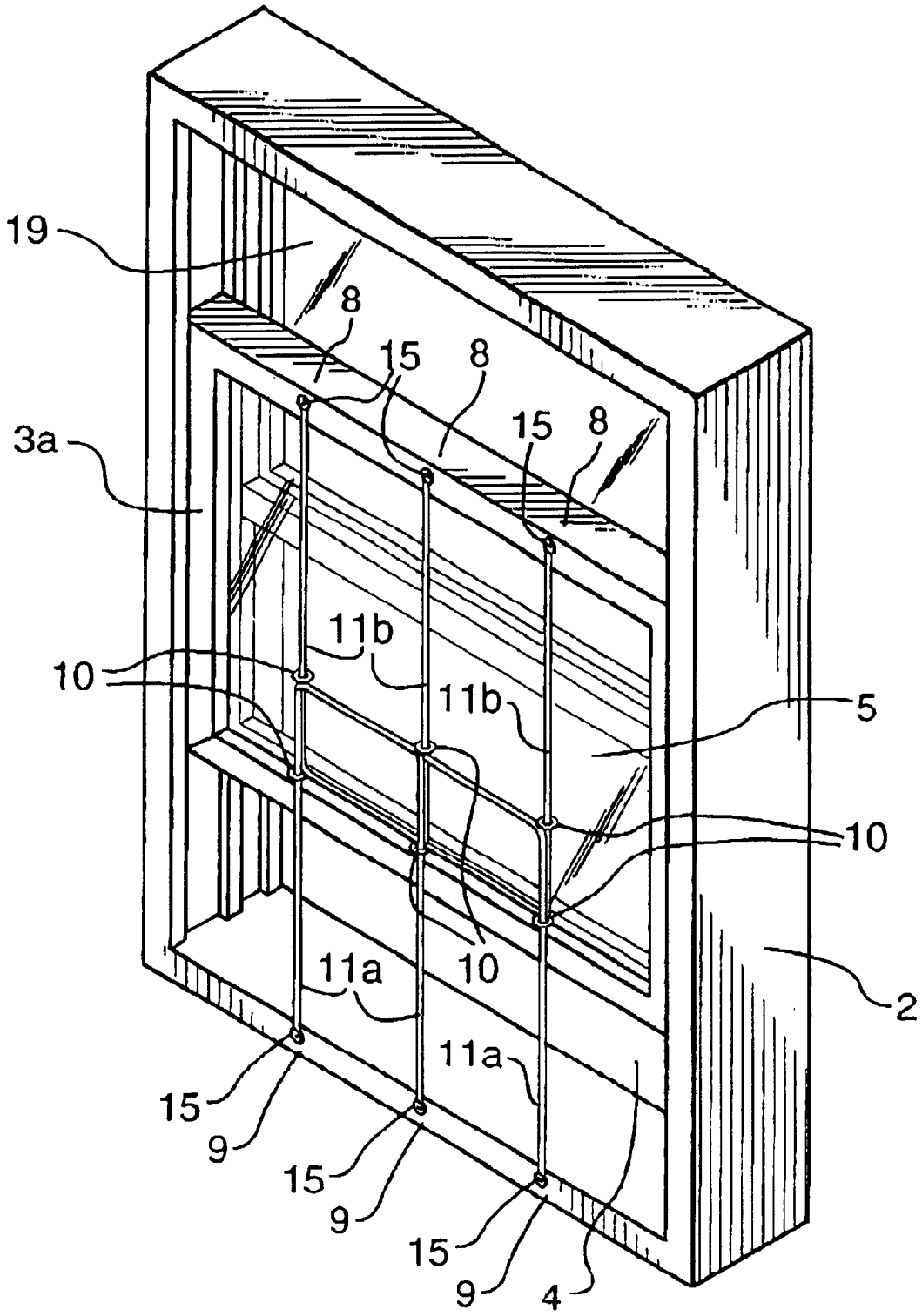
FIG. 3 is a diagram of the invention installed in an open sliding window.

FIG. 3 shows the invention installed and operating on a partially open window. There, gate 5 is attached to frame 2 and window 3*a*. At distal ends 9 of arms 11*a*, the first gate element is attached to the side of the window frame adjacent to opening 4. At distal ends 8 of arms 11*b*, the second gate element is attached to the distal end of window 3*a*. Screws 15, bolts or other suitable fasteners may be used to attach the distal ends of the gate elements to the window frame and window. Coupling elements 10 couple arms 11*a* and 11*b* of each gate element together, while allowing the gate elements to slide along each other.

It can be appreciated that with the window gate installed, open area 4 is effectively blocked by gate 5. A child, adult or sufficiently large object cannot easily pass through opening 4. At the same time, upper portion 19 of window 3 remains unblocked by gate 5, thereby allowing an unobstructed view therethrough.

Figure 4:
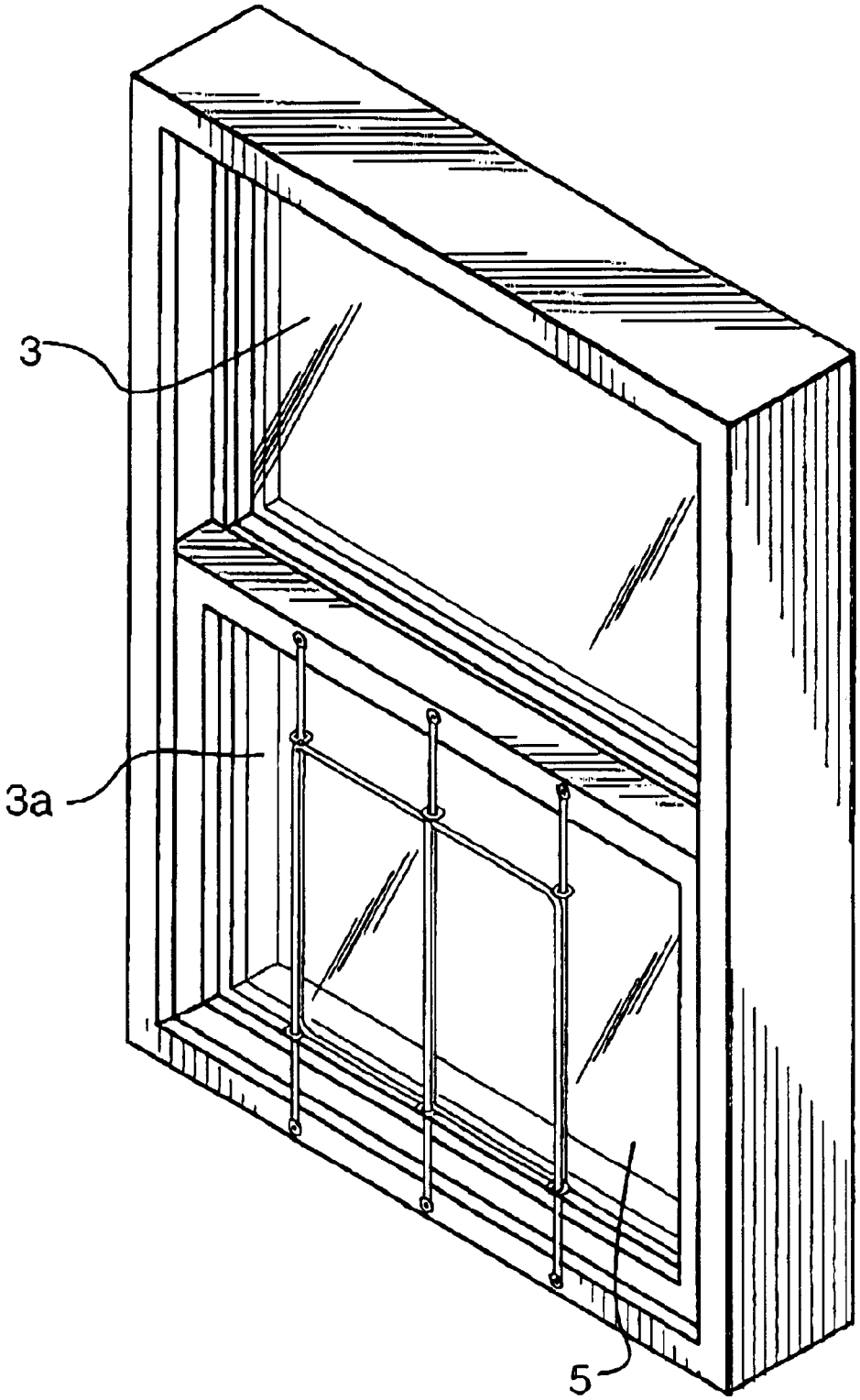
FIG. 4 is a diagram of the invention installed in a closed sliding window.

FIG. 4 shows the invention installed and positioned in a closed window. Gate 5 covers the area around window 3*a*, but not window 3. This provides an unobstructed view through window 3.

Figure 5:
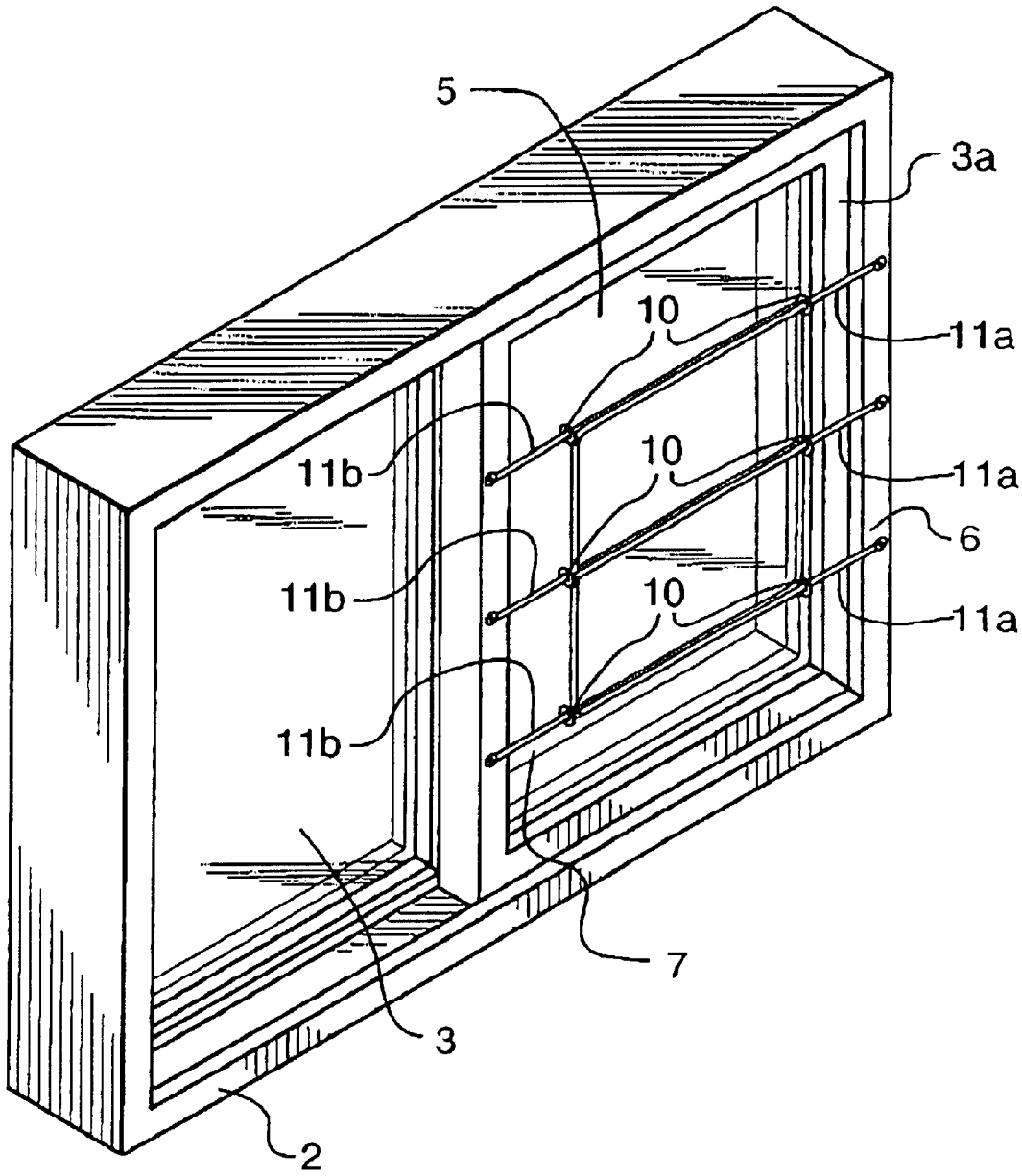
FIG. 5 is a diagram of the invention installed in a horizontal sliding window.

FIG. 5 shows the invention installed and positioned a closed horizontal window. The invention operates in the same relative manner as described for a vertical window. Gate 5 is attached to frame 2 and window 3*a*. First gate element 6 is attached to frame 2 at distal ends 9 of arms 1*a*. Second gate element 7 is attached to window 3*a* at distal ends 10 of arms 11*b*. Coupling elements 10 couple arms 11*a* and 11*b* of each gate element together. Again, there is an unobstructed view through window 3.

Figure 6:
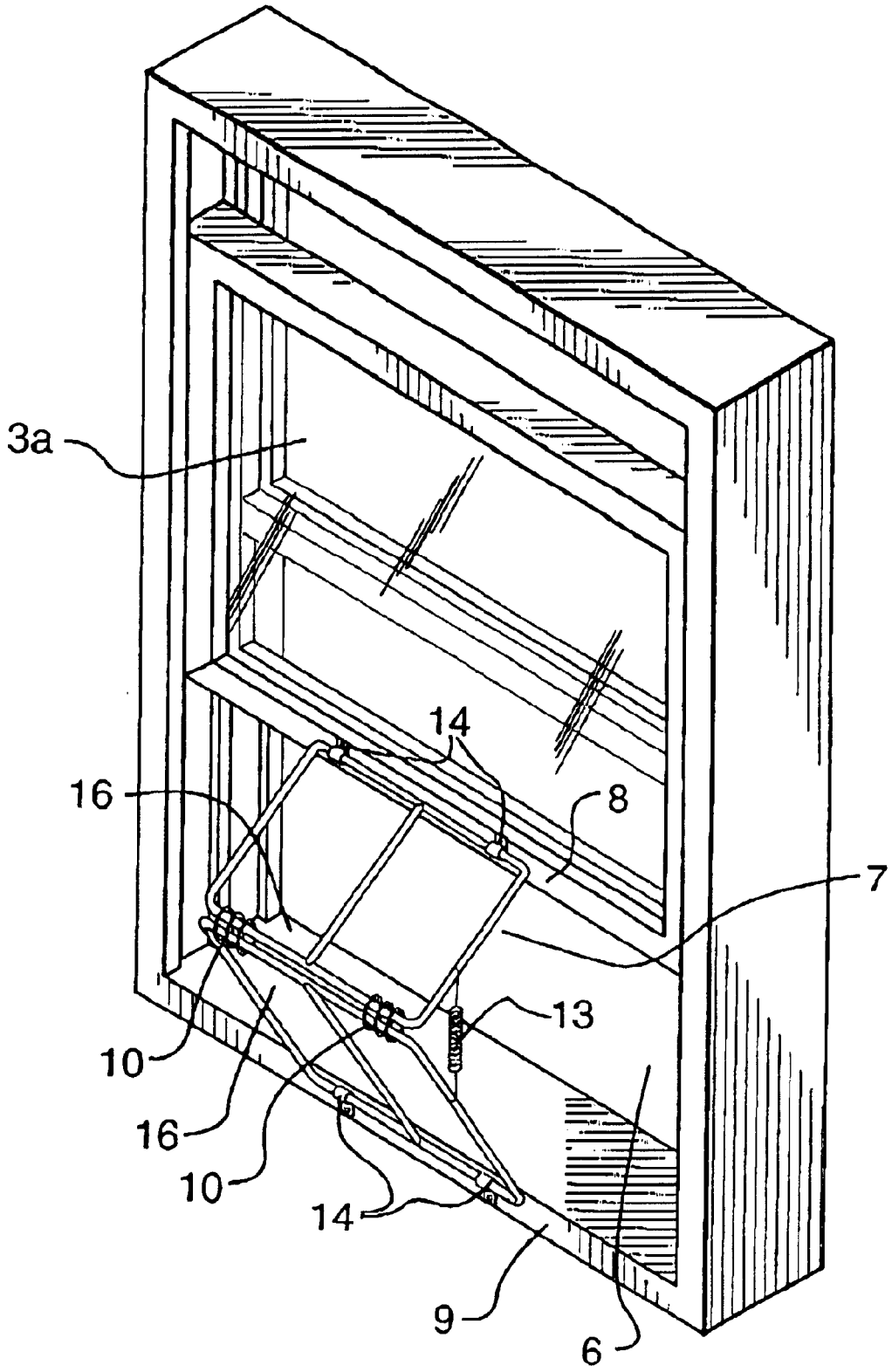
FIG. 6 is a diagram of another embodiment of the invention.

FIG. 6 shows another preferred embodiment of the invention. For clarity, only window 3*a* is shown. Here, first and second gate elements are generally rectangular in shape. At distal end 9 of first gate element 6*a* it is pivotally attached to the side of the window frame adjacent to opening 4. At distal end 8 of second gate element 7*a*, it is pivotally attached to the proximal end of window 3*a* to the opening. Hinges 14, latches or other pivoting attachment arrangements can be used to pivotally attach the gate elements to their respective parts of the window. At the proximal ends 16 of each gate element, the gate elements are pivotally coupled with coupling elements 10. Coupling elements can be coils. As such, gate 5 pivots between a closed position where the gate elements pivot outwardly away from the window frame to an open position where the gate elements pivot towards the window frame as window 3*a* is opened. In this embodiment, it can be appreciated that when the window is fully closed, gate 5 is fully pivoted away from the frame and is not in view of the frame, thereby not obstructing the view through window 3*a*. Spring 13 attaching the first and second gate elements biases together the two gate elements.

Figure 7:
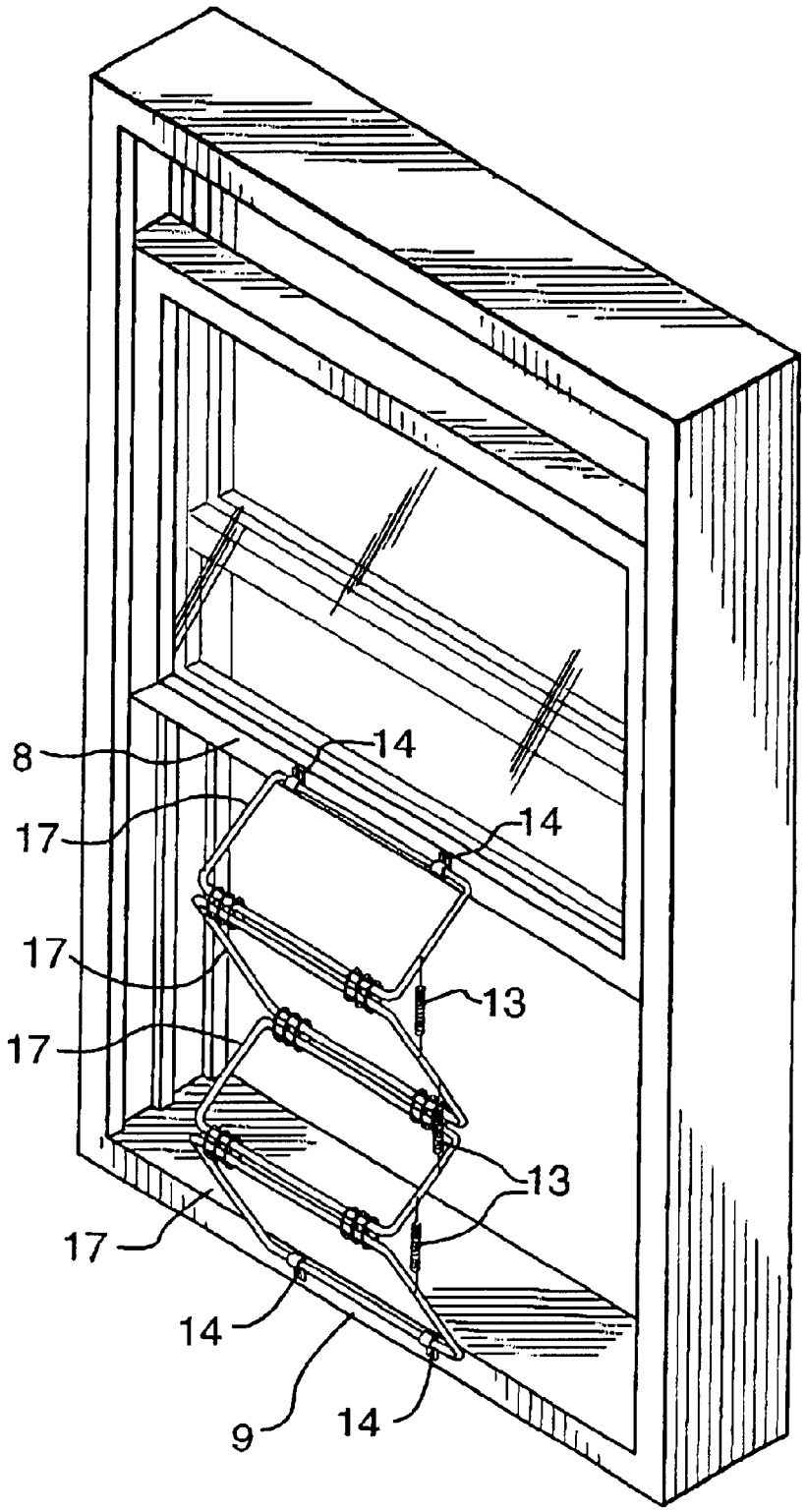
FIG. 7 is a diagram of another embodiment of the invention.

As shown in FIG. 7, the embodiment of the invention shown in FIG. 6 can be modified to utilize a plurality of gate elements 17. These gate elements may be connected together at their edges to form an accordion-styled gate arrangement, with the exterior gate elements being connected to the window and the window frame respectively. When a plurality of gate elements are used, the size of each gate element may be reduced, thereby decreasing the distance which the folded portion of the window gate extends outwardly from the window frame when the window is not fully open. Generally, the number of gate elements must be an even number to ensure that the fastened ends of the exterior gate elements can be coincidentally near the window and the window frame.

It can be appreciated that other shapes and configurations for the first and second gate elements can be used which provide the essential functionality and novelty of the invention.

Referring to FIG. 3, it can be appreciated that the size of opening 4 may be restricted by varying the lengths of arms 11*a* and 11*b*. As window 3*a* is opened, the first and second gate members extend from each other. When the travel of the first and second gates is fully extended, window 3*a* cannot be opened further. As such, it is possible to install a gate having a total extension distance less than the full travel distance of window 3*a* in frame 2. This allows the installer to control the distance to which window 3*a* can be opened.

It can be appreciated that the gate is a simple, elegant design, which is easily manufactured and installed and is inexpensive.

Although various preferred embodiments of the present invention have been described herein in detail, it can be appreciated that the present invention is not restricted to what is described above and shown in the drawings, but can be changed or modified in many different ways within the scope of the invention defined in the attached claims.

The embodiments of the invention in which an exclusive right and privilege is claimed are defined as follows:

1. In combination a window frame having a sliding window movable from a closed position to an open position in said window frame, and a gate comprising first and second gate elements, each of said first and second gate elements being either substantially rectangular or substantially U-shaped, said first gate element having a first distal end attached to said frame and said second gate element having a second distal end attached to said sliding window, said first and second gate elements coupled together allowing said gate elements to slide along each other and telescope as said sliding window is moved from said closed position to said open position to provide a barrier in a space created between said sliding window and said window frame when said sliding window is in said open position.

2. The combination as claimed in claim 1 wherein said first and second gate elements are substantially U-shaped.

3. The combination as claimed in claim 1 wherein said first and second gate elements are substantially rectangular.

4. In combination a window frame having a sliding window movable from a closed position to an open position in said window frame, and a gate comprising first and second gate elements, each of said first and second gate elements having a substantially rectangular shape with an open end comprising a plurality of arms attached to a base, said first gate element attached its said open end to said frame, said second gate element attached at its said open end to said sliding window, said first and second gate elements coupled together along at least one of said plurality of arms, whereby said gate elements slide along each other and telescope as said sliding window is moved from said closed position to said open position to provide a barrier in a space created between said window and said window frame when said sliding window is in said open position.

5. The combination as claimed in claim 4 wherein said first and second gate elements are coupled together by circular rings attached to the arms of one of said gate element through which the arms of the other gate element slide.

* * * * *